United States Patent [19]

Romer

[11] Patent Number: 4,679,737

[45] Date of Patent: Jul. 14, 1987

[54] GRINDING SUB-SAMPLING MILL AND METHOD FOR PREPARATION OF TEST SAMPLE

[75] Inventor: Thomas R. Romer, Washington, Mo.

[73] Assignee: Romer Labs, Inc., Washington, Mo.

[21] Appl. No.: 873,678

[22] Filed: Jun. 12, 1986

[51] Int. Cl.[4] ..... B02C 7/11

[52] U.S. Cl. ..... 241/29; 241/30; 241/246; 241/248; 241/257 R; 241/261.2

[58] Field of Search ..... 241/186.3, 245, 248, 241/257 R, 258, 259, 259.1, 101.7, 259.2, 30, 259.3, 101.2, 261.2, 101.3, 261.3, 29, 246, 152 A; 426/518

[56] References Cited

U.S. PATENT DOCUMENTS

| | | | |
|---|---|---|---|
| 669,060 | 2/1901 | Cascaden | 241/245 |
| 1,003,362 | 9/1911 | Knappenberger . | |
| 1,175,436 | 3/1916 | Griffin . | |
| 2,076,188 | 4/1937 | Thorsten | 241/101.2 X |
| 2,574,979 | 11/1951 | Messinger . | |
| 3,203,457 | 8/1965 | Minet . | |
| 3,830,436 | 8/1974 | Dickens | 241/101.3 X |
| 3,921,919 | 11/1975 | Zimmer | 241/245 X |
| 4,018,395 | 4/1977 | Pozzato et al. . | |

OTHER PUBLICATIONS

Dickens et al, *Subsampling Mill for Peanut Kernels,* Food Technology, 7-1969.

*Primary Examiner*—Mark Rosenbaum
*Attorney, Agent, or Firm*—Glenn K. Robbins

[57] ABSTRACT

Apparatus and method for obtaining a uniform ground sample of grain, seeds and other foodstuff of a lot to be tested for make-up composition including presence of mycotoxins. A planetary grinder is employed having for example three peripheral discharge outlets, two of which are of uniform size and the third of which has a restricted outlet to discharge a test sample, such as 6% of the entire lot being ground. The test sample has been found to have a closely similar composition to the entire lot and can be subjected to analysis of one type or another with confidence of its representative composition.

10 Claims, 7 Drawing Figures

GRINDING SUB-SAMPLING MILL AND METHOD FOR PREPARATION OF TEST SAMPLE

BACKGROUND OF THE INVENTION

In the chemical analysis of grains, seeds and other agricultural commodities or solid foodstuffs such as nuts, mixed animal foods, human foods and the like, the first two stages of the analytical process are sampling and sample preparation. The initial sample is taken from "a lot" of a given foodstuff commodity. This is normally a composite made up of several probes from different parts of the lot.

The sample must be large enough to be representative of the lot. The concentration of the analyte, i.e. the chemical that is under analysis, should be the same in the initial sample as in the lot. The size of the sample taken from the lot depends on the concentration and distribution of the analyte in the foodstuff commodity.

In the case of protein, fat, moisture and some minerals which are evenly distributed, in for example, whole kernel corn at high percentage cencentrations, a half pound is enough to qualify as a representative sample. At the other extreme of low percentage concentrations are pesticides, herbicides and mycotoxins which are not evenly distributed throughout a lot of corn and can be harmful at low concentrations in the order of parts per million, i.e. ppm and parts per billion, i.e. ppb. In the case of the mycotoxin, aflatoxin, which is regulated at the 20 ppb level, 5 to 10 pounds of corn needs to be taken from a truckload to obtain a representative sample.

Sample preparation is the second stage of the analytical process and involves size reduction, such as by grinding or comminution, mixing and separating a representative analytical test sample from the initial large probe sample taken from the lot.

In the case of aflatoxin in corn, the U.S. Department of Agriculture recommends that the total large probe sample be ground using a hammer, Wiley or disk mill to pass a size 14 sieve, split using a sample splitter such as one known as a riffler, until 1 to 2 kilogram is obtained. This is reground to pass a size 20 sieve. The reground portion is mixed thoroughly in a tumble blender or planetary mixer. The analytical sample to be tested is taken from this mix using a sample splitter.

The above procedure requires a grinding mill of one type or another, a riffler and a mixer and takes about 30 minutes to obtain an analytical sample. The time required along with the various pieces of equipment employed represent a considerable investment of time and money.

SUMMARY OF THE INVENTION

By means of this invention there has been provided an apparatus and method which greatly reduces the time and equipment required to obtain the second stage analytical test sample of solid foodstuffs or solid agricultural commodities.

The apparatus of this invention provides for both the grinding and mixing of the large probe sample in one piece of equipment. A planetary grinder, or as it may also be termed a disc grinder, is employed having a multiplicity of peripheral discharge outlets, one of which has an adjustable restricted opening for the discharge of the analytical test sample which represents a minor portion of the solid foodstuff being ground while the major portion is discharged through the other outlets.

Typically the grinder may have three uniformly spaced discharge outlets about the periphery of the grinder of uniform discharge size. One of the outlets (the collection outlet) is used to provide the test sample and has an adjustable restricted opening. The restricted opening is simply adjusted to provide discharge of the desired test percentage of the total discharge. An analytical sample may then be weighed from the test sample and the remainder of the test sample may be stored as a file sample.

The grinder may be employed to collect less than 1% (by proper adjustment of the restricted opening) to 50% (by completely closing the restricted opening) of the ground sample.

In the case of aflatoxin, studies have been performed with hole kernel corn naturally contaminated with aflatoxin B-1 in which 2500 gram were ground and subsampled with the restricted opening adjusted to allow for collection of 125 gram (5%) of ground corn. Several 25 gram samples of each 125 gram were tested for aflatoxin by thin layer chromatography. The discard portions (about 1200 gram each) from each 2500 gram was ground to pass a 20 mesh screen and 3×25 gram riffled samples were tested for aflatoxin by thin layer chromatography. The results showed that the collection sample was as representative as the discard sample.

The grinder of this invention employs a pair of conventional planetary or disc grinder heads one of which is rotated with the solid foodstuff introduced between the grinder heads and expelled as it is ground to the periphery of the grinder. The provision of circumferentially spaced discharge outlets, one of which has an adjustable restricted discharge opening provides a simple and efficient method for collecting a test sample quickly and with reliable uniformity.

The mixer and grinder apparatus of this invention is rugged and can be used in the field at a fraction of the cost previously required for both equipment and time. The grinder is easily employed without any rigorous training and lends itself to widespread use in the agricultural industry. It may be simply adjusted to provide selected test sample discharge percentage as desired.

The above features are objects of this invention. Further objects will appear in the detailed description which follows and will be further apparent to those skilled in the art.

For the purpose of illustration of this invention, a preferred embodiment thereof is shown in the accompanying drawing. It is to be understood that the drawing is for purpose of description only and that the invention is not limited thereto.

IN THE DRAWING

DESCRIPTION OF THE INVENTION

Figure 1:
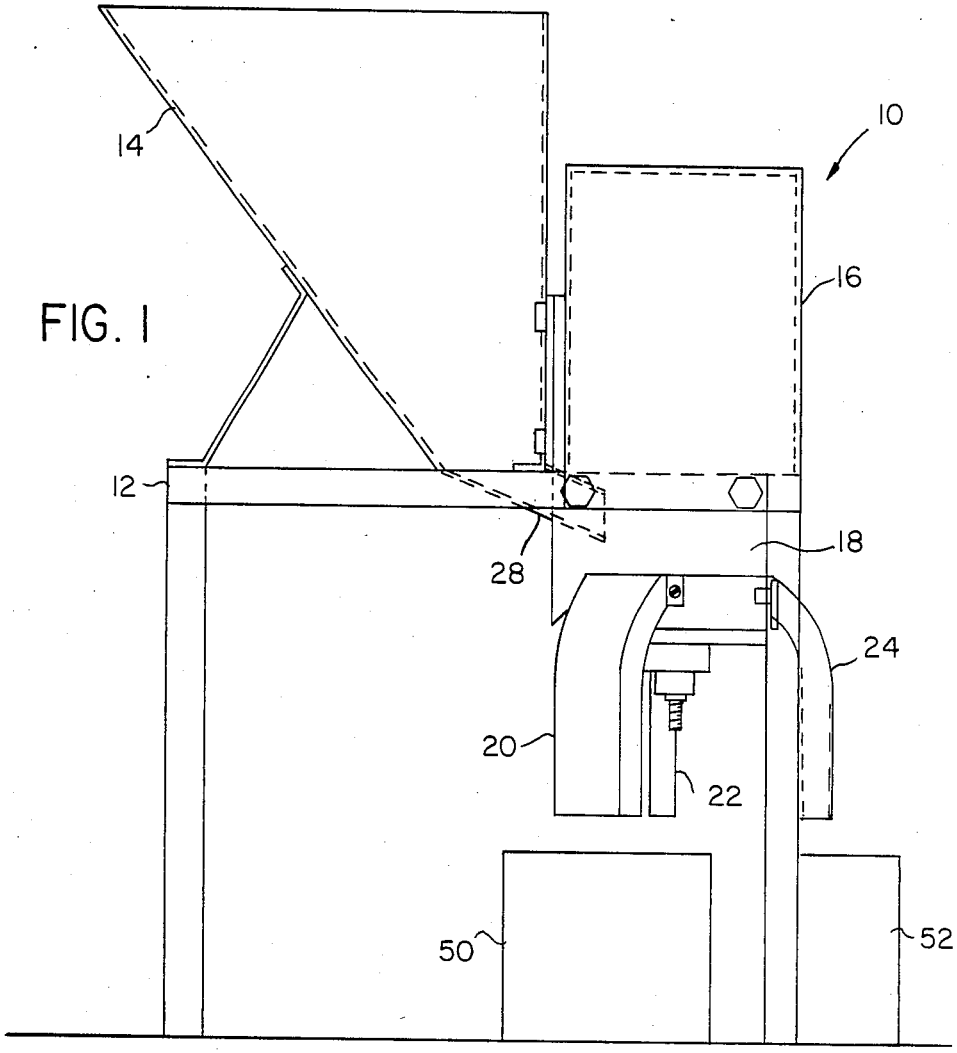
FIG. 1 is a view in front elevation of the grinder.
Figure 2:
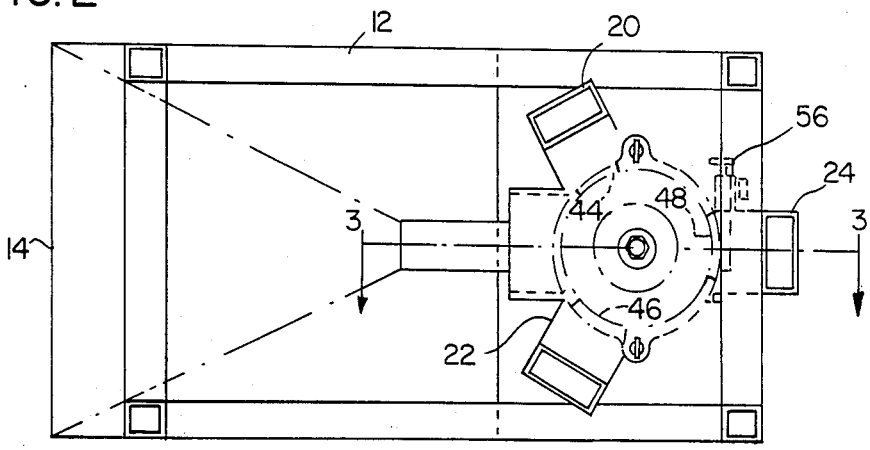
FIG. 2 is a bottom plan view.
Figure 3:
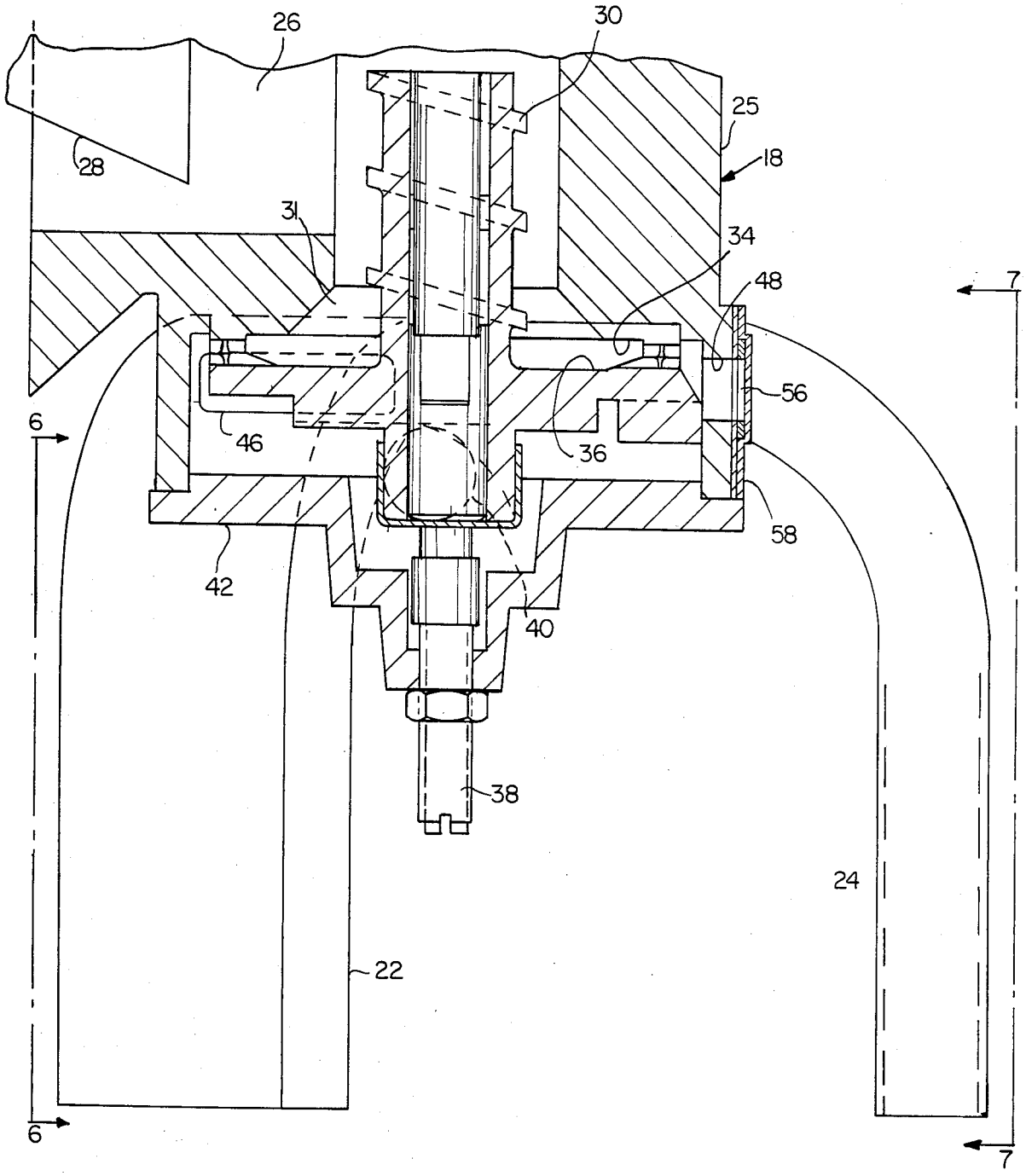
FIG. 3 is an enlarged view in section taken on line 3—3 of FIG. 2.
Figure 4:
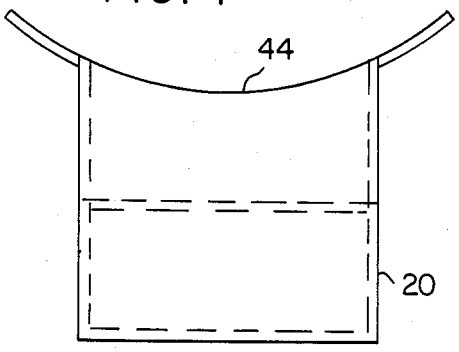
FIG. 4 is an enlarged fragmentary plan view of one of the main discharge tubes.

The grinder apparatus of this invention is generally identified by the reference numeral 10 in FIGS. 1, 2 and 3. It is comprised of stand 12 supporting a hopper 14, motor 16, grinder unit 18 and three discharge or collector tubes 20, 22 and 24, the latter being for the collection of the small percentage test sample.

The grinder unit, per se, is of conventional construction in that it has a housing 25 having an inlet 26 communicating with a feed conduit 28 of the hopper, an auger 30 in a vertical feed passage 31 and a drive shaft 32. A stationary top annular grinder plate 34 is connected to the housing and a rotary bottom grinder plate 36 is connected to the auger 30. A drive shaft 38 is keyed to the bottom grinder plate by a key 40. A removeable bottom cover plate 42 provides access to the interior of the grinder unit for replacement of the grinder plates as desired. Such grinder units having one outlet are conventional and, per se, are not of this invention.

In order to provide for the collection of the small test sample to be analyzed, a plurality of outlets in the housing are provided. There are three outlets 44, 46 and 48 which are connected to discharge tubes 20, 22 and 24, the latter outlet 48 and tube 24 being for the collection of the small representative test sample. The outlet openings are formed in the periphery of the housing equidistantly around its circumference and aligned between the top and bottom grinder plates. The discharge tubes 20 and 22 are directed into a discharge receptacle 50 while the test sample tube 24 is directed into an analysis collection receptacle 52.

Figure 5:
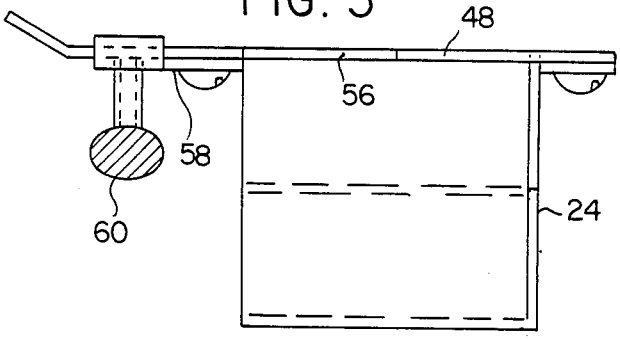
FIG. 5 is an enlarged fragmentary plan view of the test specimen discharge tube.
Figure 6:
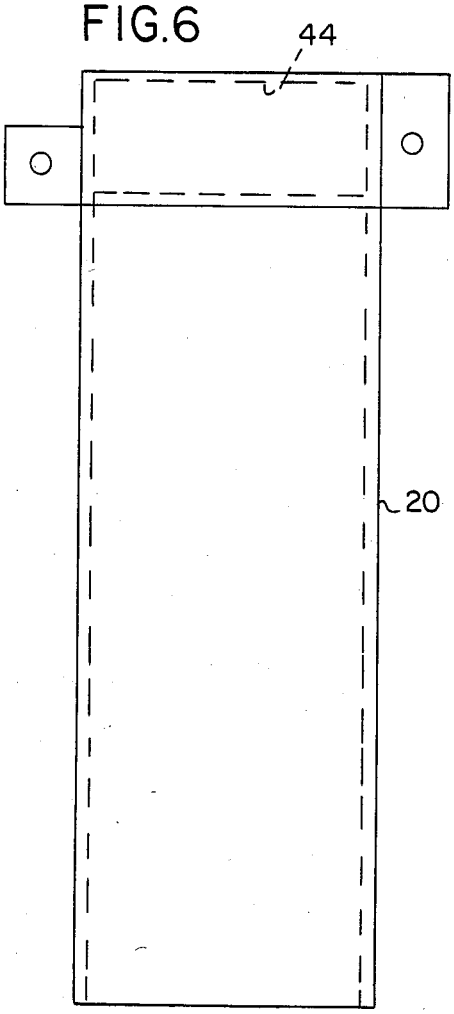
FIG. 6 is a front elevation enlarged view of one of the regular discharge tubes.
Figure 7:
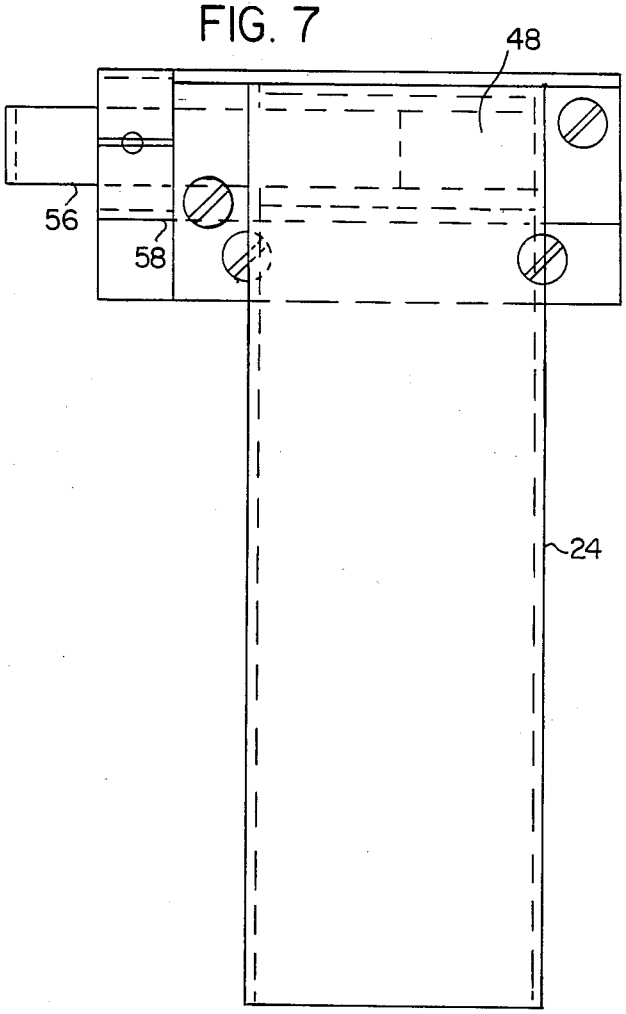
FIG. 7 is a front elevation enlarged view of the test specimen discharge tube.

An adjustment plate 56 is employed to restrict the effective discharge area of the outlet 48 leading to the collection test sample tube 24. It is best shown in FIGS. 2, 3, 5 and 7. The adjustment plate is mounted in a slide bracket 58 in registry with outlet 48. A tightening screw 60 provides for locking the adjustment plate in selected positions of adjustment. For purpose of example, the adjustment plate is shown in FIGS. 5 and 7 in the half closed position. This has been found to provide a 6% test sample of ground corn through tube 24 with the remaining 94% being distributed through the discard tubes 20 and 22. The percentage of distribution through the restricted outlet 48 is worked out empirically for different positions of adjustment and as can be seen is not the same percentage as the area of the restricted outlet with respect to the total outlet area including the unrestricted outlets 44 and 46. It may also vary depending on the physical characteristics of the solid foodstuff being studied.

METHOD OF USE

The test grinder 10 of this invention is designed for simple and efficient use in the field. It finds a very important use at grain elevators and feed mill sites where a short preparation time is required. It will be understood, however, that it may be employed for other solid foodstuffs and agricultural commodities.

The test grinder is portable and by virtue of its stand mount may be set up quickly and easily upon any support surface such as a table or the like. The larger probe test sample, such as corn, to be ground and prepared for the small analaytical test sample is simply placed in the hopper 14 and fed into the grinder unit 18 through the conduit 28. The auger 30 charges the corn to the rotary bottom grinder plate 36. The corn is ground between the stationary top grinder plate 34 and the rotary grinder plate and is passed centrifugally at the outer periphery of the grinder plates to the housing discharge outlets 44 and 46 and the restricted outlet 48. The small test sample to be analyzed is charged through collection tube 24 into receptacle 52 while the major portion is charged for discard through tubes 20 and 22 into discard receptacle 50.

The adjustment plate may be adjusted as desired to present different size restricted openings to deliver varying small test percentages. The adjustment openings are simply determined empirically for different types of solid foodstuffs. It will be understood that a chart may be prepared for the varying adjustments such as the type for seeders which are commonly employed for agricultural equipment.

The grinder 10 greatly simplifies the apparatus and method of sample preparation for mycotoxin analysis in grain and particularly corn. The equipment of this invention used to prepare a corn sample for aflatoxin analysis with a blender represents a cost saving of considerable amount, in the order of 50% to 75%. The time required is reduced from about 30 minutes to about 5 minutes. When the adjustable restrictor plate 56 is set at a one-half restricted opening for outlet 48 of the grinder, a test sample of 6% of the ground corn is delivered through the collection tube 24 to the collection receptacle 52.

For an initial large probe sample of 2500 grams, or a little more than 5 pounds, 150 grams of ground corn is collected. For whole kernel corn naturally contaminated with aflatoxin, this 150 grams is representative in composition of the initial 2500 gram probe sample. Further, in the sample preparation the 150 gram test sample can be quickly ground to a finer particle size in a blender. A 25 gram analytical sample taken from the blender is representative of the 150 gram sample obtained from the grinder verifying that the total sample preparation procedure is valid.

Various changes and modifications may be made within this invention as will be apparent to those skilled in the art. Such changes and modifications are within the scope and teaching of this invention as defined in the claims appended hereto.

What is claimed is:

1. Apparatus for uniformly grinding a solid foodstuff and obtaining a small representative sample thereof, said apparatus comprising hopper means for delivering discrete particles of said foodstuff to a planetary grinder, said grinder being comprised of a housing supporting a stationary grinder head and a rotary grinder head therein and means for introducing said foodstuff therebetween, said grinder heads being supported within a housing having a multiplicity of separate discharge outlets spaced about the periphery of the grinder heads, said outlets collectively forming a minor portion of the periphery, a major portion of the periphery being closed, one of said outlets having adjustment means for restricting the size of the outlet to provide discharge of a selected small percentage of uniformly ground and uniform composition foodstuff to a sample test collection receptacle, said grinder heads being in a horizontal planes to deliver ground foodstuff horizontally to said discharge outlets, the entire grinder heads lying in a horizontal plane, said outlets being equidistantly spaced peripherally around said housing and aligned to bridge outside edges of said heads.

2. The apparatus of claim 1 in which the restricted outlet is connected to a vertically extending discharge tube adapted to be directed to said collection receptacle and the remaining outlets are connected to discharge tubes adapted to be directed to a separate discard receptacle.

3. The apparatus of claim 1 in which said adjustment means comprises a moveable adjustment plate slidably mounted on said housing and being moveable across the opening to form a restriction to the outlet and provide a preselected small percentage discharge through said restricted outlet of the total discharge through all the outlets.

4. The apparatus of claim 1 in which said grinder is mounted on a portable stand and there are at least three discharge outlets.

5. the apparatus of claim 4 in which the stand has legs supporting the grinder above a work base upon which the stand may be supported and the restricted outlet is connected to a vertically extending discharge tube adapted to be directed to said collection receptacle and the remaining outlets are connected to discharge tubes adapted to be directed to a separate discharge receptacle.

6. The apparatus of claim 5 in which the adjustment means comprises a moveable adjustment plate slidably mounted on said housing and being moveable across the opening to form a restriction to the outlet and provide a preselected small percentage discharge through said restricted outlet of the total discharge through all the outlets.

7. A method for uniformly grinding a solid foodstuff to obtain a small representative sample, said method comprising charging discrete particles of said foodsutff to a planetary grinder having a pair of aligned horizontally extending throughout their entirety grinder heads at least one of which is rotary, said foodstuff being introduced centrally between said grinder heads and being expelled as it is ground centrifugally outwardly between the heads, collecting said ground foodstuff in a plurality of discharge outlets spaced equidistantly about the periphery of and bridging outside edges of the grinder heads, restricting one of said outlets while the other outlets remain open to provide a selected small percentage test sample of the total discharge ground foodstuff and segregating the collected ground foodstuff from the restricted outlet as a small percentage test sample of uniform composition for analysis.

8. The method of claim 7 in which the solid foodstuff is grain to be tested for mycotoxins.

9. The method of claim 8 in which the grain is corn to be tested for aflatoxin.

10. The method of claim 7 in which a portion of the test sample is ground further in a blender to a smaller particle size for further analysis.

* * * * *